United States Patent [19]

Gupta et al.

[11] 4,398,950

[45] Aug. 16, 1983

[54] HIGH STRENGTH COLD ROLLED, WELDABLE STEEL STRIP

[75] Inventors: Indra Gupta, Munster; Raymond V. Fostini, Crown Point; Timothy E. Moss, Highland, all of Ind.

[73] Assignee: Inland Steel Company, Chicago, Ill.

[21] Appl. No.: 56,329

[22] Filed: Jul. 10, 1979

[51] Int. Cl.[3] ..... F16H 29/10

[52] U.S. Cl. ..... 75/124; 75/123 M

[58] Field of Search ..... 75/124 R, 124 B, 124 E, 75/123 D, 123 M; 148/36

[56] References Cited

U.S. PATENT DOCUMENTS

| | | | |
|---|---|---|---|
| 2,916,375 | 12/1959 | Middleham et al. | 75/124 E |
| 3,110,798 | 11/1963 | Keay | 75/124 BC |
| 3,857,740 | 12/1974 | Gondo et al. | 148/12 F |
| 3,899,368 | 8/1975 | Waid et al. | 148/36 |
| 4,029,934 | 6/1977 | Clark et al. | 75/124 B |
| 4,094,670 | 6/1978 | Bruno et al. | 75/124 ED |
| 4,141,724 | 2/1979 | Brickner et al. | 148/36 |
| 4,141,761 | 2/1979 | Abraham et al. | 148/36 |

OTHER PUBLICATIONS

Fine et al., "Spot Weldability of High Strength, Cold-Rolled Steel", Feb. 26, 1979, Society of Automotive Engineers, Inc., Warrendale, Pa.

*Primary Examiner*—L. Dewayne Rutledge
*Assistant Examiner*—John P. Sheehan
*Attorney, Agent, or Firm*—Merriam, Marshall & Bicknell

[57] ABSTRACT

A cold rolled steel strip is provided with a relatively high yield strength together with good resistance spot weldability, while avoiding rolling problems during its manufacture. This is accomplished by adding, to plain carbon steel, phosphorus in an amount greater than 0.04 wt. % up to 0.15 wt. % and 0.04–0.14 wt. % titanium.

9 Claims, No Drawings

HIGH STRENGTH COLD ROLLED, WELDABLE STEEL STRIP

BACKGROUND OF THE INVENTION

The present invention relates generally to cold rolled steel strip, and more particularly to high strength, cold rolled steel strip having good resistance spot weldability and to methods for producing such steel strip.

Many of the components assembled into automobiles are formed from cold rolled steel strip, and these components may be subjected to resistance spot welding operations during their manufacture or during the assembly of the automobile. As a result of the current emphasis on decreasing the amount of gasoline consumed by automobiles, it is important that the weight of the automobile and its components be reduced because decreased gasoline consumption accompanies decreased weight. Heretofore, components of automobiles have been formed from ordinary, low carbon, cold rolled steel strip. This material, although having excellent resistance spot weldability, must be relatively thick in order to provide the strength required. Because ordinary cold rolled steel strip is relatively thick, the weight of the components manufactured from this strip, and of the automobile into which the components are assembled, is also relatively heavy.

The thickness of a steel strip can be reduced by increasing the strength of the steel. The strength of low carbon, cold rolled steel strip can be increased by adding small amounts (e.g., less than 1.0%) of alloying elements such as columbium, vanadium or titanium. Phosphorus can also be added to improve the strength of the steel. Vanadium, columbium and titanium increase the strength of the steel by forming precipitates in the matrix of the steel, while phosphorus increases the strength of the steel by a mechanism known as solid solution strength hardening.

Although all of these alloying ingredients increase the strength of the steel and thereby permit a reduction in thickness of the steel strip compared to a plain carbon steel strip of the same strength, each of these alloying elements, by itself, produces other drawbacks. For example, columbium, vanadium or titanium, besides being expensive, cause a loss of productivity during the rolling of steel containing these elements because such steels require reduced running speeds for the rolling mills used in their manufacture. These elements also tend to cause recrystallization problems in the steel and produce a non-uniform product when coils of steel strip containing these elements are subjected to a batch annealing operation which normally follows the cold rolling operation.

The problems described in the preceding paragraph do not occur when phosphorus is used as a strengthening ingredient. However, a high strength steel, the strength of which is improved by the addition of phosphorus, has relatively poor weldability. A steel strip has good resistance spot weldability when it is weldable over a relatively wide current range for relatively short weld times and when the weld nuggets produced on the steel strip exhibit what is known as a ductile peel test fracture which is substantially insensitive to increased hold time during the welding operation.

When columbium, or titanium alone, is used as a steel strengthening agent, the weldability of the steel strip is relatively good. However, in cold rolled steel strip strengthened with phosphorus, or phosphorus plus columbium, the range of currents at which these steels can be resistance welded at short weld times is relatively narrow so that appreciably longer weld times are required, compared to plain carbon steels, and the weld nuggets produced from the welding of such steels exhibit undesirable fracture characteristics in peel tests.

SUMMARY OF THE INVENTION

In accordance with the present invention, there is produced a cold rolled steel strip having good resistance spot weldability together with high strength characteristics. This is accomplished by adding to the steel, as strengthening ingredients, phosphorus in an amount greater than 0.04 wt.% up to 0.15 wt.% and titanium in the range of 0.04–0.14 wt.%. The resulting cold rolled steel strip has a yield strength in the range of about 40,000–60,000 PSI (276–414 MPa), and a ductility, expressed as uniform elongation, of 18–22%.

Unlike a cold rolled steel strip containing both columbium and phosphorus as strengthening agents, a steel strip which has poor resistance spot weldability, it has been determined that, when titanium and phosphorus are added to the steel, in accordance with the present invention, the resulting cold rolled steel strip has relatively good resistance spot weldability. The strip can be welded over a relatively wide current range, at short weld times, and the resistance spot welded steel strip produces weld nuggets which exhibit a ductile peel test fracture which is substantially insensitive to increased hold time during the welding operation.

The relatively wide current range in which the steel strip is weldable is comparable to that for a plain carbon steel strip having the same composition but without the alloying additions of phosphorus and titanium. The weld nuggets on the strip have a ductile to brittle transition temperature, when tested in shear impact, comparable to plain carbon steel.

A cold rolled steel strip produced in accordance with the present invention has a weldability index, expressed as $$\frac{\text{\% of ductile welds at 30 cycles hold time}}{\text{\% of ductile welds at 5 cycles hold time}},$$

in the range of about 0.5–1.0, preferably.

Other features and advantages are inherent in the product and method claimed and disclosed or will become apparent to those skilled in the art from the following detailed description.

DETAILED DESCRIPTION

A strong, ductile, cold rolled steel strip having improved resistance spot weldability is prepared in accordance with the present invention by starting with a composition consisting essentially of, in weight percent:

| | |
|---|---|
| Carbon | .04–.10 |
| Manganese | .3–.7 |
| Silicon | 0.01–0.30 |
| Aluminum | 0.03–0.12 |
| Phosphorus | greater than .04 up to .15 |
| Titanium | .04–.14 |
| Iron | essentially the balance |

In a typical embodiment, steel having this composition is formed into slabs using conventional slab-making practice. The slabs are reheated to a temperature greater than about 2300° F. (1260° C.) and hot rolled to appropriate strip gauges, finishing the hot rolling operation at a temperature in the range 1550°-1750° F. (843°-954° C.). The hot rolled strip is coiled at a coiling temperature in the range 1050°-1250° F. (566°-677° C.). The hot rolled strip is then subjected to a cold rolling operation in which more than 50% reduction is performed. The cold rolling operation is followed by a conventional batch annealing operation at a temperature in the range 1100°-1350° F. (649°-732° C.) or continuous annealing in the temperature range of 1300°-1550° F. (730°-843° C.). Following annealing, the cold rolled strip is subjected to a conventional skin rolling operation in which the strip is subjected to about 0.5-2% reduction, using conventional practices.

The resulting cold rolled steel strip has a recrystallized grain structure with an ASTM grain size in the range 10-13, in a typical embodiment. The yield strength of the cold rolled steel strip is about 40,000-60,000 PSI (276-414 MPa), and the ductility, expressed as uniform elongation, is in the range 18-22%.

The resulting cold rolled steel strip is weldable over a relatively wide current range comparable to a plain carbon steel strip having the same composition but without the alloying additions of phosphorus and titanium. When resistance spot welded nuggets produced on this steel strip are subjected to peel test fracture, the resulting nuggets are round and unfractured at faying surfaces, and the production of ductile peel test fracture nuggets is substantially insensitive to increased hold time during the welding operation.

The nugget peel test is a conventional test utilized to reflect the resistance spot weldability of steel strip. A steel strip which has good weldability produces a round peel test nugget while a steel strip having relatively poor weldability produces an irregular shaped peel test nugget with ragged fracture lines extending across the nugget. This reflects a brittle fracture at so-called "faying" surfaces. A brittle weld nugget, in effect, reduces the effective size of the weld nugget and is undesirable. To avoid brittle fracture, the welding current must be increased, and this decreases the current range at which an acceptable nugget can be obtained. Not only does this expend more energy, but, also, it reduces the flexibility of the manufacturing operation. Accordingly, a steel strip which produces brittle weld nuggets is unacceptable to purchasers of steel strip which is to be subjected to a welding operation.

When subjected to shear impact testing, the weld nuggets exhibit a ductile to brittle transition temperature in the range −40° C. to −80° C. This is comparable to that exhibited by weld nuggets on plain carbon steel.

A cold rolled steel strip in accordance with the present invention is not a deep drawing steel which normally has an $\bar{r}$ value (an indication of deep drawing properties) above about 1.5. In contrast, the steel strip in accordance with the present invention has an $\bar{r}$ value of less than about 1.3.

In order to avoid hot rolling problems during manufacture of the strip, it is important to maintain the silicon content of the steel at a maximum limit of 0.30 wt.%.

With a phosphorus content at the lower end of the range given above (i.e., up to 0.07 wt.%) the steel may be continuously cast. Otherwise, the steel should be cast in ingot molds.

In the tables set forth below, Table I gives the composition of some examples of cold rolled steel strip produced in accordance with the present invention (Steels 2-5), Table II gives the mechanical properties of these steels, and Table III shows the welding characteristics of the steels. For comparison purposes, also listed in these tables are a steel which is strengthened with columbium plus phosphorus (Steel 1), and a plain carbon steel without additional strengthening ingredients (Steel 6). Unless expressly indicated as having undergone continuous annealing, all the steels described in the following tables have been batch annealed.

TABLE I

| | Composition, wt. % | | | | | | |
|---|---|---|---|---|---|---|---|
| Steel | C | Mn | Si | Al | P | Cb | Ti |
| 1 | 0.07 | 0.53 | Res. | 0.051 | 0.14 | 0.029 | Res. |
| 2 | 0.07 | 0.54 | Res. | 0.067 | 0.13 | Res. | 0.05 |
| 3 | 0.08 | 0.57 | Res. | 0.07 | 0.10 | Res. | 0.065 |
| 4 | 0.07 | 0.61 | 0.27 | 0.028 | 0.06 | Res. | 0.08 |
| 5 | 0.05 | 0.37 | Res. | 0.071 | 0.095 | Res. | 0.11 |
| 6 | 0.06 | 0.30 | Res. | 0.050 | Res. | Res. | Res. |

TABLE II

| Steel | Annealing Temp. °F. | Yield Strength ksi(I) | Tensile Strength ksi(II) | Uniform Elongation % | Total Elongation in 2", % | Elastic Ratio I/II |
|---|---|---|---|---|---|---|
| 1 | 1170 | 55.0 | 73.0 | 18.0 | 29.8 | 0.75 |
| | 1235 | 55.8 | 74.3 | 19.0 | 29.0 | 0.75 |
| 2 | 1170 | 60.4 | 76.2 | 19.7 | 28.8 | 0.79 |
| | 1235 | 58.0 | 73.0 | 21.9 | 29.0 | 0.79 |
| 3 | 1170 | 57.3 | 73.0 | 18.5 | 30.0 | 0.78 |
| | 1235 | 55.8 | 71.1 | 18.9 | 27.3 | 0.78 |
| 4 | 1170 | 55.1 | 71.8 | 18.2 | 27.5 | 0.77 |
| | 1235 | 53.9 | 71.4 | 18.5 | 26.8 | 0.75 |
| 5 | 1200 | 60.0 | 74.6 | 18.4 | 26.0 | 0.786 |
| | 1300 | 53.8 | 67.8 | 20.5 | 29.5 | 0.770 |
| 6 | 1300 | 26.0 | 44.0 | 23.0 | 42.0 | 0.591 |

TABLE III

| Steel | Weld Constants | Thickness in | Thickness mm | Current Ranges, in Amperes, at Designated Weld Cycles 6 | 8 | 10 | 12 | 14 | 20 |
|---|---|---|---|---|---|---|---|---|---|
| 1 | (1) | 0.036 | 0.92 | — | — | 650 | — | 800 | 1550 |
| 2 | (1) | 0.036 | 0.92 | — | — | 1250 | — | 2350 | 2600 |
| 3 | (1) | 0.036 | 0.92 | — | — | 1300 | — | 1950 | 2450 |
| 4 | (1) | 0.036 | 0.92 | — | 900 | 1650 | — | 2300 | 2650 |
| 5 | (2) | 0.030 | 0.76 | 1000 | 1250 | 1600 | — | 2000 | 2300 |
| 6 | (3) | 0.030 | 0.76 | — | 700 | 1600 | 1550 | — | — |

| | (1) | (2) | (3) |
|---|---|---|---|
| Squeeze Time = Cycles | 50 | 50 | 50 |
| Hold Time = Cycles | 60 | 60 | 25 |
| Electrode Force, lbs. (N) | 500(2240) | 450(2020) | 450(2020) |
| Electrode diameter in (mm) | .24(6.1) | .1875(.1875(4.75) | |
| Minimum nugget Diameter, in (mm) | .15(3.8) | .15(3.8) | .15(3.8) |

Table III shows that Steel 1 (P+Cb) has a relatively small current range which is reflective of poor weldability while Steels 2-5 (P+Ti in accordance with the present invention) have a weldability comparable to plain carbon steel (Steel 6).

Table IV lists the chemical compositions of cold rolled steel strips having, as strengthening agents, columbium alone (Steel 7), titanium alone (Steel 8), phosphorus alone (Steel 11), columbium plus phosphorus (Steel 9), and titanium plus phosphorus in accordance with the present invention (Steels 10 and 12). Table V shows the weldability index and Table VI shows the mechanical properties of cold rolled steel strip made from the steel compositions listed in Table IV.

TABLE IV

| Steel | Composition, wt. % | | | | | | |
|---|---|---|---|---|---|---|---|
| | C | Mn | P | S | Al | Ti | Cb |
| 7(Cb) | 0.06 | 0.38 | 0.012 | 0.017 | 0.058 | 0.004 | 0.032 |
| 8(Ti) | 0.06 | 0.37 | 0.012 | 0.017 | 0.055 | 0.09 | <0.008 |
| 9(Cb + P) | 0.08 | 0.035 | 0.064 | 0.014 | 0.095 | 0.006 | 0.024 |
| 10(Ti + P) | 0.07 | 0.36 | 0.067 | 0.014 | 0.10 | 0.12 | <0.008 |
| 11(P) | 0.08 | 0.36 | 0.067 | 0.014 | 0.10 | 0.002 | <0.008 |
| 12(Ti + P) | 0.07 | 0.35 | 0.068 | 0.014 | 0.091 | 0.06 | <0.008 |

TABLE V

| Steel | Ingot Location | Percentages of Ductile Peel Test Fractures at Hold Cycles of | | Weldability Index* |
|---|---|---|---|---|
| | | 5 | 30 | |
| 7(Cb) | Bottom | 100 | 100 | 1 |
| | Top | 100 | 100 | 1 |
| 8(Ti) | Bottom | 67 | 90 | 1.34 |
| | Top | 100 | 100 | 1 |
| 9(Cb + P) | Bottom | 0 | 0 | 0 |
| | Top | 0 | 0 | 0 |
| 10(Ti + P) | Bottom | 100,91 | 70,63 | 0.7, 0.69 |
| | Top | 100 | 78 | 0.78 |
| 11(P) | Bottom | 0 | 0 | 0 |
| | Top | 0 | 0 | 0 |
| 12(Ti + P) | Bottom | 67 | 29 | 0.43 |
| | Top | 64 | 5 | 0.08 |

*Ratio of $\frac{\text{\% ductile welds at 30 hold cycles}}{\text{\% ductile welds at 5 hold cycles}}$

TABLE VI

| Steel | Yield Strength ksi | Tensile Strength ksi | Uniform Elongation % | Total Elongation in 2", % |
|---|---|---|---|---|
| 7(Cb) | 44.9–47.5 | 59.5–60.5 | 18.0–19.5 | 29.0–30.0 |
| 8(Ti) | 47.8–50.3 | 62.8–64.3 | 18.4–19.5 | 28.0–30.5 |
| 9(Cb + P) | 47.5–49.8 | 65.5–66.6 | 19.4–20.4 | 29.0–30.0 |
| 10(Ti + P) | 51.4–55.2 | 68.0–70.1 | — | 24.5–26.0 |
| 11(P) | 37.2–37.5 | 57.0–58.8 | 23.2–24.3 | 34.0–38.1 |
| 12(Ti + P) | 46.9–52.1 | 64.6–68.8 | 19.8–21.8 | 29.0–33.5 |

As shown in Table V, Steel 9 (Cb+P) and Steel 11 (P alone) both have weldability indexes of zero. The other steels (Cb alone, Ti alone or Ti+P) have high or relatively high weldability indexes.

Table VII sets forth the composition of two cold rolled steel strips of the same thickness, one containing phosphorus and titanium in accordance with the present invention (Steel 13) and the second containing phosphorus and columbium (Steel 14). Both steels were continuous annealed after cold rolling, in accordance with the present invention, in the temperature range of 1400°–1500° F. (760°–816° C.). The mechanical properties of the annealed product are given in Table VIII.

Table IX compares the hold-time sensitivity of Steel 13, containing titanium plus phosphorus, in accordance with the present invention, with that of Steel 14, containing columbium plus phosphorus as strengthening ingredients. Table IX shows that the titanium plus phosphorus composition, in accordance with this invention, does not exhibit brittle peel test fractures as a function of hold time while the phosphorus plus columbium steel exhibits brittle peel test fractures at hold times greater than 5 cycles.

TABLE VII

| Steel | Composition, Wt. % | | | | | | | |
|---|---|---|---|---|---|---|---|---|
| | C | Mn | P | S | Si | Cb | Ti | Al |
| 13 | 0.06 | 0.37 | 0.043 | 0.025 | 0.023 | 0.008 | 0.066 | 0.042 |
| 14 | 0.04 | 0.41 | 0.05 | 0.024 | 0.026 | 0.023 | 0.006 | 0.049 |

TABLE VIII

| Steel | Yield Strength psi (I) | Tensile Strength psi (II) | Total Elongation in 2", % | Elastic Ratio (I/II) |
|---|---|---|---|---|
| 13 | 54,000–61,000 | 62,200–69,400 | 27–30 | 0.86–0.88 |
| 14 | 53,300–59,000 | 62,300–67,200 | 30–31 | 0.85–0.88 |

TABLE IX

THE INFLUENCE OF HOLD TIME ON THE PEEL TEST FRACTURE FOR A SPOT WELD MADE IN A P + Ti AND A P + Cb COLD ROLLED HIGH STRENGTH STEEL

| Weld Time Cycles | Weld Conditions | | |
|---|---|---|---|
| | Electrode Force Newtons | Electrode Diameter mm | Hold Time Cycles |
| 9 | 2530 | 5.55 | 1 to 60 |

| Hold Time Cycles | Peel Test Nugget | | | |
|---|---|---|---|---|
| | Steel 13 | | Steel 14 | |
| | Diameter, mm | Fracture Mode | Diameter, mm | Fracture Mode |
| 1 | 4.82 | Ductile | 5.3 | Ductile |
| 3 | — | — | 5.2 | Ductile |
| 10 | 4.8 | Ductile | 4.2 | Brittle |
| 20 | — | — | 3.7 | Brittle |
| 30 | 4.93 | Ductile | 3.42 | Brittle |
| 60 | 4.97 | Ductile | 3.52 | Brittle |

Table X sets forth the composition of three cold rolled steel strips, one containing phosphorus and titanium in accordance with the present invention (Steel 15), another containing only titanium as a strengthening agent (Steel 16) and a third being a plain carbon steel without added phosphorus or titanium or other strengthening additions (Steel 17).

Table XI compares the weldability of Steel 15, containing titanium plus phosphorus in accordance with the present invention, with that of Steel 16 containing only titanium as a strengthening ingredient. Table XI shows that neither steel exhibits brittle peel test fracture as a function of hold time (cooling rate).

Table XII also pertains to the steel strips of Table X and shows that the Steel 15 (containing titanium plus phosphorus) and Steel 16 (containing titanium alone) have weldability characteristics comparable to that of a cold rolled plain carbon steel strip without alloying additions (Steel 17).

TABLE X

| Steel | Composition, Wt. % | | | | | |
|---|---|---|---|---|---|---|
| | C | Mn | S | Al | P | Ti |
| 15 | 0.08 | 0.36 | 0.015 | 0.022–0.025 | 0.044 | 0.05 |
| 16 | 0.08 | 0.37 | 0.015 | 0.04 | 0.008 | 0.085 |
| 17 | 0.06 | 0.37 | 0.016 | 0.056 | 0.012 | 0.004 |

TABLE XI

| Steel | Thickness mm | Weld Cycle | Hold Cycles | Weld Conditions: Electrode Force, N | Electrode Dia. mm | Current Amps | Welding Peel Test: Nugget Diam. mm | Fracture Mode |
|---|---|---|---|---|---|---|---|---|
| 13(Ti + P) | 0.71 | 9 | 5 | 2060 | 4.76 | 6800 | 5.05 | Ductile |
| | | 9 | 30 | 2060 | 4.76 | 6800 | 4.77–4.97 (4.88 avge.) | |
| 14(Ti) | 0.71 | 9 | 5 | 2060 | 4.76 | 7200 | 4.85 | Ductile |
| | | 9 | 30 | 2060 | 4.76 | 7200 | 4.77–5.33 (4.95 avge.) | |

TABLE XII

CURRENT REQUIREMENTS TO OBTAIN THE MINIMUM SET-UP PEEL TEST BUTTON DIAMETERS

| Steel | Set-Up Current, Amperes |
|---|---|
| 17 (plain carbon) | 7400 |
| 16 (Ti) | 7200 |
| 15 (Ti + P) | 6800 |

CURRENT RANGE, BETWEEN THE MINIMUM (MIN.) BUTTON DIAMETER AND THE EXPULSION POINT (EXP.), WHERE ACCEPTABLE WELDS CAN BE MADE

| Steel | Current, Amperes: Min. | Exp. | Range |
|---|---|---|---|
| 17 (plain carbon) | 6100 | 7800 | 1700 |
| 16 (Ti) | 6100 | 7850 | 1750 |
| 15 (Ti + P) | 5400 | 7300 | 1900 |

The foregoing detailed description has been given for clearness of understanding only, and no unnecessary limitations should be understood therefrom, as modifications will be obvious to those skilled in the art.

We claim:

1. A strong, ductile, cold rolled steel strip having good resistance spot weldability, said strip comprising:

a composition consisting essentially of, in wt.%:

| | |
|---|---|
| carbon | .04–.10 |
| manganese | .3–.7 |
| silicon | 0.01–0.30 |
| aluminum | 0.03–0.12 |
| sulfur | .03 max. |
| phosphorus | greater than .04 up to .15 |
| titanium | .04–.14 |
| iron | essentially the balance; |

and a yield strength in the range of about 40,000–60,000 psi (276–414 MPa).

2. A cold rolled steel strip as recited in claim 1 and having a ductility, expressed as uniform elongation, of 18–22%.

3. A cold rolled steel strip as recited in claim 1 and comprising:

a recrystallized grain structure having an ASTM grain size in the range 10–13.

4. A cold rolled steel strip as recited in claim 1 wherein:

said steel strip has a weldability index expressed as $$\frac{\text{\% of ductile welds at 30 cycles hold time}}{\text{\% of ductile welds at 5 cycles hold time}}$$

in the range of about 0.5–1.0.

5. A cold rolled steel strip as recited in claim 1 wherein:

said steel strip produces weld nuggets, when resistance spot welded, which exhibit a ductile peel test fracture which is substantially insensitive to increased hold time during the welding operation.

6. A cold rolled steel strip as recited in claim 1 wherein:

said steel strip is weldable over a relatively wide current range comparable to a plain carbon steel strip having the same composition but without alloying additions of phosphorous and titanium.

7. A cold rolled steel strip as recited in claim 1 wherein:

the ductile to brittle transition temperature for a resistance welded nugget on said strip, subjected to shear impact testing, is in the range −40° to −80° C.

8. A method for improving the resistance spot weldability of a cold rolled steel strip having a composition consisting essentially of, in wt.%:

| | |
|---|---|
| carbon | .04–.10 |
| manganese | .3–.7 |
| silicon | 0.01–0.30 |
| aluminum | 0.03–0.12 |
| sulfur | .03 max. |
| iron | essentially the balance, |

while providing said cold rolled steel strip with a yield strength in the range 40,000–60,000 psi (276–414 MPa), said method comprising the step of:

including, in the composition of said cold rolled steel strip, 0.04–0.14 wt.% titanium and greater than 0.04 up to 0.15 wt. % phosphorous.

9. A method as recited in claim 7 wherein said cold rolled steel strip has a ductility, expressed as uniform elongation, of 18–22%.

* * * * *

UNITED STATES PATENT AND TRADEMARK OFFICE

CERTIFICATE OF CORRECTION

PATENT NO. : 4,398,950

DATED : August 16, 1983

INVENTOR(S) : Indra Gupta, Raymond V. Fostini, Timothy E. Moss

It is certified that error appears in the above-identified patent and that said Letters Patent are hereby corrected as shown below:

Col. 8, line 56, change "7" to --8--.

Signed and Sealed this

*Nineteenth* Day of *June 1984*

[SEAL]

*Attest:*

GERALD J. MOSSINGHOFF

*Attesting Officer*

*Commissioner of Patents and Trademarks*